US006568377B1

(12) United States Patent
Yuan et al.

(10) Patent No.: US 6,568,377 B1
(45) Date of Patent: May 27, 2003

(54) OXYGEN-REPLENISHING DEVICE FOR ENGINES

(76) Inventors: Andy Yuan, 4th Fl., 3, Sublane 7, Lane 257, Li Nung Street, Sec. 1, Taipei City (TW); Szu-Cheng Ma, 4th Fl, 106, Ching Yun Road, TuCheng City, Taipei Hsien (TW)

( * ) Notice: Subject to any disclaimer, the term of this patent is extended or adjusted under 35 U.S.C. 154(b) by 0 days.

(21) Appl. No.: 10/160,260

(22) Filed: Jun. 4, 2002

(51) Int. Cl.[7] ..... F02M 25/06
(52) U.S. Cl. ..... 123/572; 123/573
(58) Field of Search ..... 123/572, 573, 123/574, 41.86

(56) References Cited

U.S. PATENT DOCUMENTS 4,011,846 A * 3/1977 Gagliardi ..... 123/572
4,409,950 A * 10/1983 Goldberg ..... 123/573
6,058,917 A * 5/2000 Knowles ..... 123/572
6,152,120 A * 11/2000 Julazadeh ..... 123/572
6,422,224 B1 * 7/2002 Walker, Jr. ..... 123/573

* cited by examiner

*Primary Examiner*—Marguerite McMahon
(74) *Attorney, Agent, or Firm*—Rosenberg, Klein & Lee

(57) ABSTRACT

The present invention relates to an oxygen-replenishing device for engines having an inlet head with a first through hole, an outlet end with a second through hole, a connection bar, an air filter and an inlet damping ring. The inlet head and the outlet end are screwed at both ends of the connection bar. The flat middle part of the connection bar is used to keep both through holes unblocked. The air filter in shape of tube is fixed at the inner side of the outlet end by means of a suppressing ring in the middle of the connection bar. The inlet damping ring is made of clay and formed in shape of tube. A protection cover with longitudinal openings is fitted to the outer side of the inlet damping ring and fixed by the suppression of the inlet head and the outlet end. Accordingly, the connection bar and the air filter are positioned within the inlet damping ring. Furthermore, two packing rings within the inlet head and the outlet end are disposed at both ends of the inlet damping ring.

1 Claim, 4 Drawing Sheets

OXYGEN-REPLENISHING DEVICE FOR ENGINES

BACKGROUND OF THE INVENTION

1. Field of the Invention

The present invention relates to an oxygen-replenishing device for engines which has small volume and supplies sufficient oxygen gas for mixing with the fuel according to driving conditions.

2. Description of the Prior Art

It's important for an engine to inhale sufficient air. If the inflow air rate is insufficient, the fuel combustion will be incomplete, thereby causing waste of energy and air pollution. TW 247591 discloses an intake amplifying device for vehicles. It purposes an additional amount of sucked air by means of the vacuum suction created by an inlet manifold during operation of motor. Therefore, the inflow air rate of the inlet manifold is increased. However, this prior art is formed by many parts, such as main body, air filter, piston ring of internal cylinder, resilient elements, mounting plate, mixing seat, etc. Thus, the structure thereof is quite complicated so that it often malfunctions. Particularly, the effect of the whole body will be influenced when any of the piston ring, the resilient elements and the valve malfunctions.

Most of engines, as shown in FIG. 4, are provided with an active exhaust retrieval tube 71 within a cylinder. A PCV vacuum valve 7 is interposed between the retrieval tube 71 and the engine while the other end of the retrieval tube 71 is connected to an inlet manifold so that steam of machine oil within the engine can be circulated through the retrieval tube 71. According to the law of conservation of kinetic energy, the exhaust can be reduced when oxygen gas is given to the retrieval tube 71. Accordingly, the combustion of fuel-air mixture can be improved.

SUMMARY OF THE INVENTION

It is a primary object of the present invention to provide an oxygen-replenishing device for engines in which the inlet head and the outlet end are connected by a connection bar. An air filter is fixed at the inner side of the outlet end while an inlet damping ring is interposed between the inlet head and the outlet end in order to create vacuum suction. Accordingly, air enters the inlet head and the inlet damping ring and passes through the air filter and the outlet end to lead to the inlet manifold. Thus, the present invention has small volume and supplies sufficient oxygen gas for mixing with the fuel according to driving conditions.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
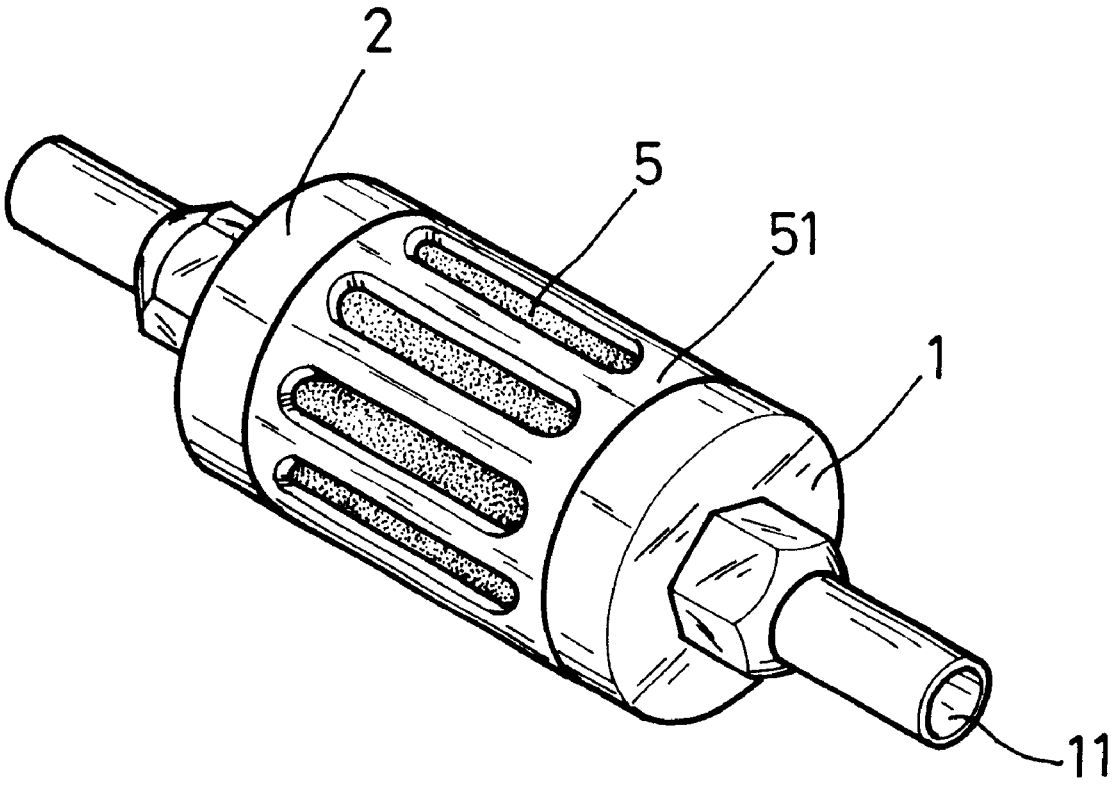
FIG. 1 is a perspective view of an embodiment of the present invention.
Figure 2:
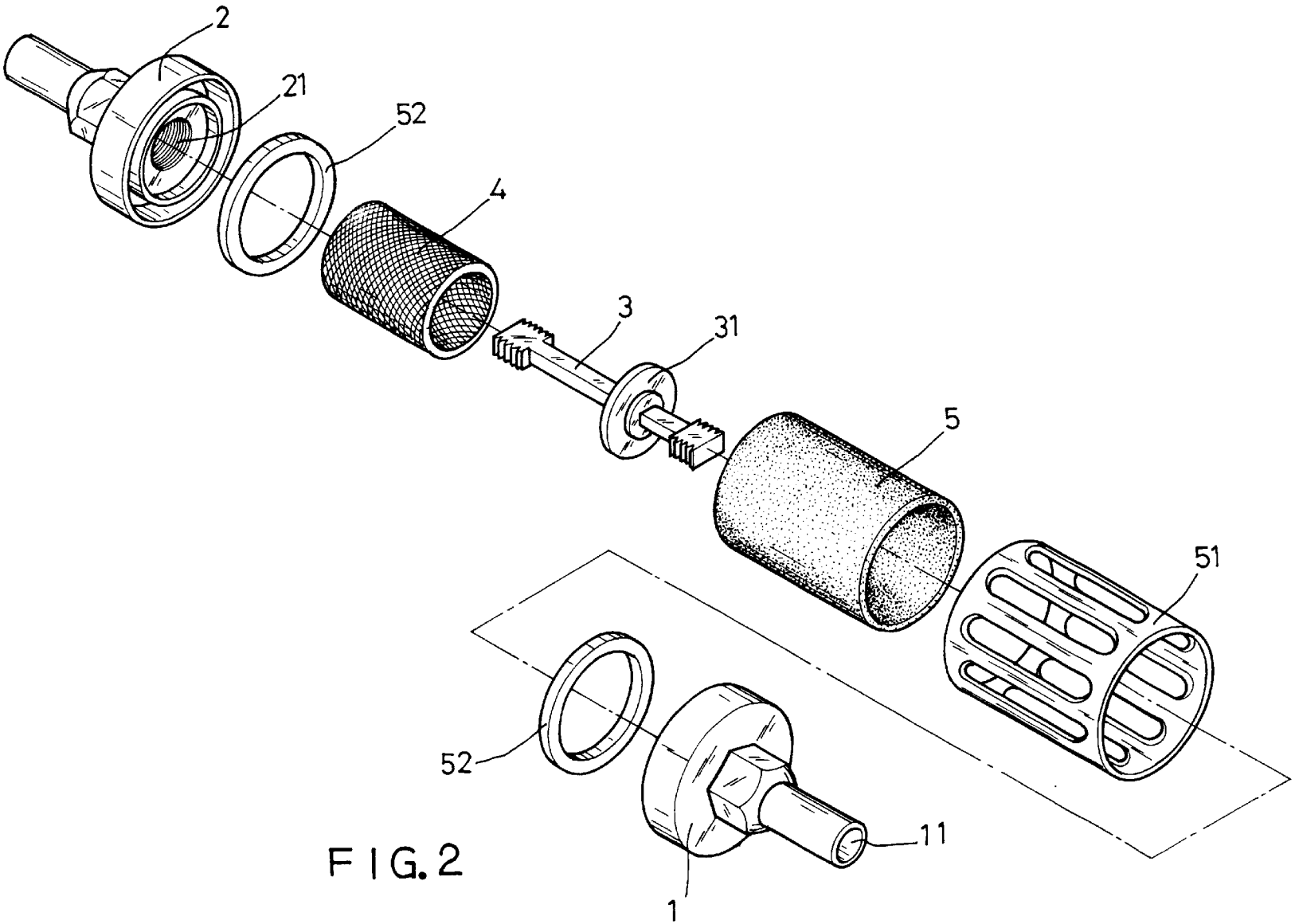
FIG. 2 is an exploded view of the embodiment of the present invention.
Figure 3:
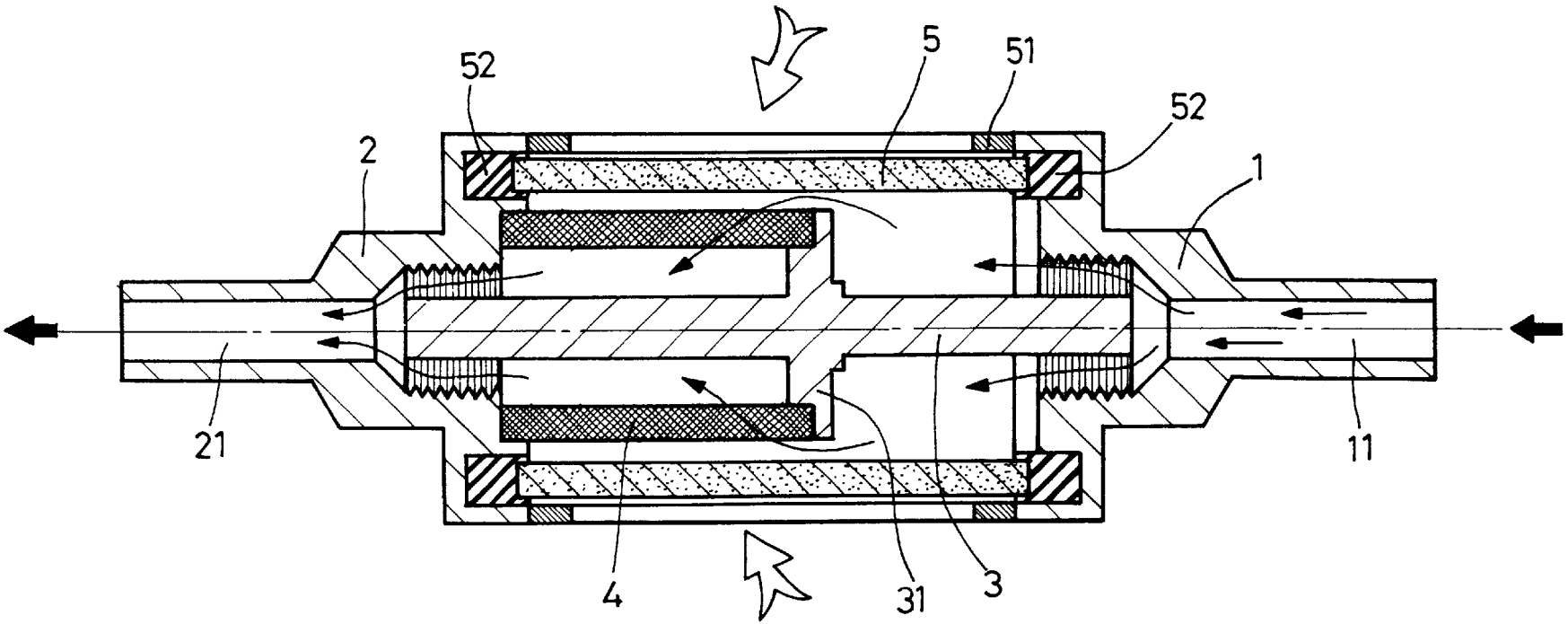
FIG. 3 is a sectional view of the embodiment of the present invention.

First of all, referring to FIGS. 1 through 3, the present invention includes an inlet head 1 with a first through hole 11, an outlet end 2 with a second through hole 21, a connection bar 3, an air filter 4 and an inlet damping ring 5.

The inlet head 1 and the outlet end 2 are screwed at both ends of the connection bar 3. The flat middle part of the connection bar 3 is used to keep both through holes 11, 12 unblocked.

The air filter 4 in shape of tube is fixed at the inner side of the outlet end 2 by means of a suppressing ring 31 in the middle of the connection bar 3.

The inlet damping ring 5 is made of clay and formed in shape of tube. A protection cover 51 with a plurality of longitudinal openings is fitted to the outer side of the inlet damping ring 5 and fixed by the suppression of the inlet head 1 and the outlet end 2. Accordingly, the connection bar 3 and the air filter 4 are positioned within the inlet damping ring 5. Furthermore, two packing rings 52 within the inlet head 1 and the outlet end 2 are disposed at both ends of the inlet damping ring 5.

Figure 4:
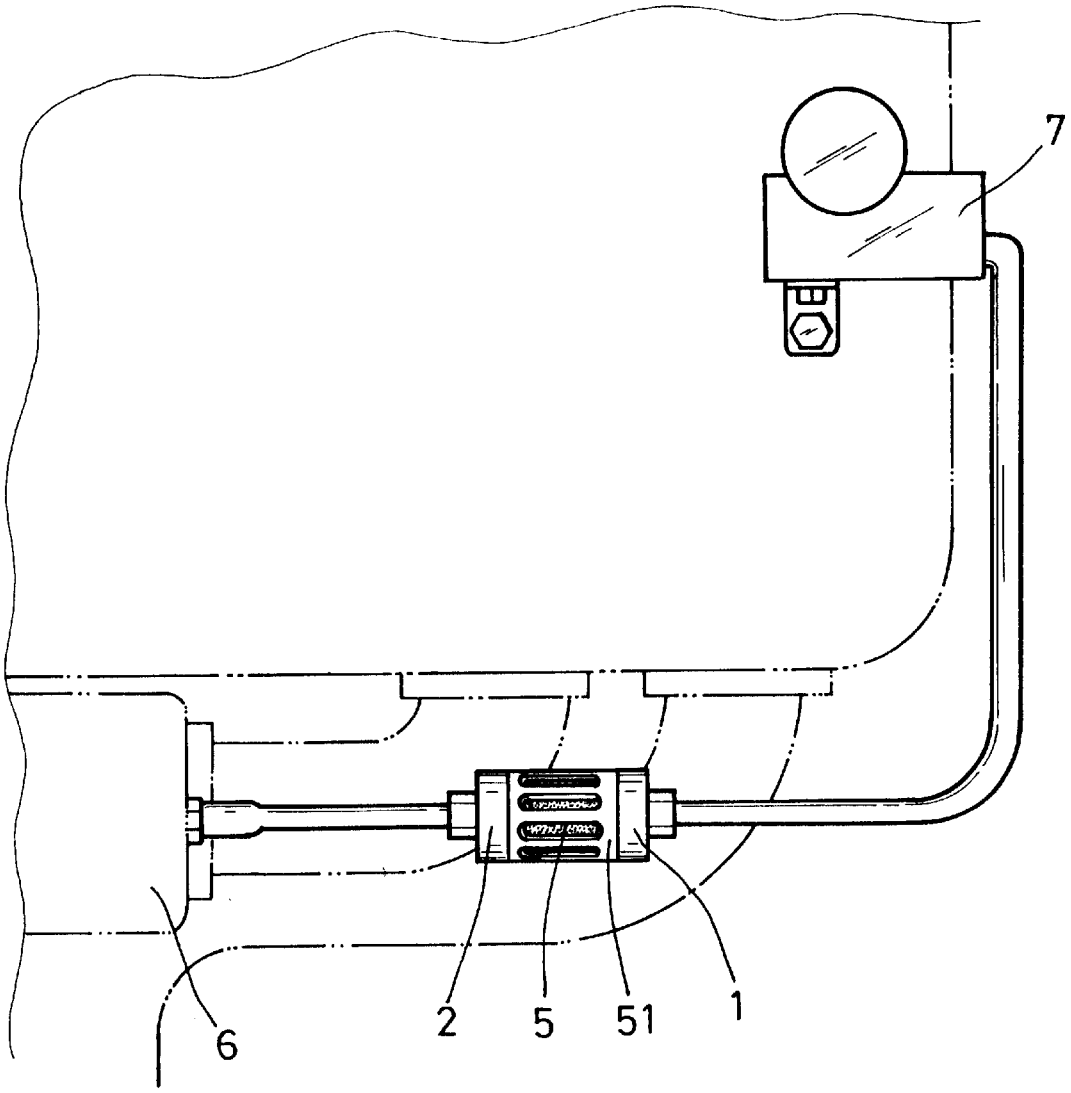
FIG. 4 is a schematic drawing of the application state of the present invention.

Based upon the above configuration, FIG. 4 shows a schematic drawing of the application state of the present invention. The present invention is interposed between the inlet manifold 6 of an engine and the retrieval tube 71 of a PCV vacuum valve 7. The vacuum suction created by the inlet manifold 6 leads to airflow shown in FIG. 3. The inflow air enters the first through hole 11 of the inlet head 1 or the inlet damping ring 5, passes through the air filter 4 for filtration and reaches the inlet manifold 6. Furthermore, the inlet damping ring 5 made of clay has fine quality and permeable space, thereby reaching damping and air-filtering effect. In addition, oxygen in the air can be enriched through the pores of the inlet damping ring 5 and is then given to the cylinder for improvement of the combustion of fuel-air mixture. According to the law of conservation of kinetic energy, the exhaust can be reduced and the power raised when the exhaust is combusted due to the oxygen enrichment.

Since the PCV vacuum valve 7 and the active exhaust retrieval tube 71 are secondary inlet ports and the compensation air is replenishing type, the air inflow rate is small. After accurate calculation, small volume design is taken for convenient assembly. Besides, the sintering density of ceramic has to do with the air inflow rate. The higher the ceramic density is, the greater the damping effect is, so that the impurities in the air can be completely filtered. However, the air inflow rate will be slighter. To the contrary, the lower the ceramic density is, the slighter the damping effect is so that filtering effect is reduced while the air inflow rate is greater. In accordance with the air quality in the surroundings, the ceramic density can be duly chosen in order to create an optimal balance between the damping filtering effect and the air inflow rate.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. An oxygen-replenishing device for engines comprising:

an inlet head with a first through hole;

an outlet end with a second through hole;

a connection bar at both ends of which said inlet head and said outlet end are screwed and whose flat middle part is used to keep both through holes unblocked, an air filter in the shape of a tube fixed at the inner side of said outlet end by means of a suppressing ring in the middle of said connection bar; and an inlet damping ring made of clay and formed in the shape of a tube, a protection cover with a plurality of longitudinal openings being fitted to the outer side of said inlet damping ring and fixed by the suppression of said inlet head and said outlet end so that said connection bar and said air filter are positioned within said inlet damping ring, two packing rings within said inlet head and said outlet end being disposed at both ends of said inlet damping ring.

* * * * *